US006868697B2

(12) United States Patent
Baum et al.

(10) Patent No.: US 6,868,697 B2
(45) Date of Patent: Mar. 22, 2005

(54) ENGAGEMENT SET WITH LOCKING ARRANGEMENT AND REAR CROSSOVER CONFIGURATION

(75) Inventors: Robert Baum, 1 E. 33rd St., New York, NY (US) 10016; Laura Leoni, Freeport, NY (US); Mirash Sinishtay, Stormville, NY (US)

(73) Assignee: Robert Baum, New York, NY (US)

( * ) Notice: Subject to any disclaimer, the term of this patent is extended or adjusted under 35 U.S.C. 154(b) by 0 days.

(21) Appl. No.: 10/610,103

(22) Filed: Jun. 30, 2003

(65) Prior Publication Data

US 2004/0050096 A1 Mar. 18, 2004

Related U.S. Application Data

(60) Provisional application No. 60/427,659, filed on Nov. 19, 2002.

(51) Int. Cl.[7] ..... A44C 9/00

(52) U.S. Cl. ..... 63/15.1; 63/15; 63/15.2; 63/1.11

(58) Field of Search ..... 63/1.11, 1.16, 63/15, 15.1, 15.2, 15.3, 15.4

(56) References Cited

U.S. PATENT DOCUMENTS

| | | | | | |
|---|---|---|---|---|---|
| 448,892 | A | * | 3/1891 | Stager | 63/15.4 |
| 549,674 | A | * | 11/1895 | Lederer | 63/15.4 |
| 984,803 | A | * | 2/1911 | Dinuccio | 40/299.01 |
| 1,327,606 | A | | 1/1920 | Bacharach | |
| 1,395,488 | A | * | 11/1921 | Ginder | 63/15.3 |
| 1,536,540 | A | | 5/1925 | Thomas | |
| 1,712,417 | A | | 5/1929 | Beaujard, Jr. | |
| 1,724,130 | A | * | 8/1929 | Dayton et al. | 63/15.1 |
| 1,936,604 | A | * | 11/1933 | Moldenhauer | 63/15 |
| 1,972,128 | A | * | 9/1934 | Bobbroff | 63/15 |
| 1,982,864 | A | | 12/1934 | Granat | |
| 2,000,228 | A | | 5/1935 | Harris | |
| 2,016,679 | A | * | 10/1935 | Mayer | 63/15.1 |
| 2,048,878 | A | * | 7/1936 | Moldenhauer | 63/15 |
| 2,059,228 | A | * | 11/1936 | Granat | 63/15.3 |
| 2,117,176 | A | * | 5/1938 | Keehnel et al. | 63/15.4 |
| 2,177,314 | A | * | 10/1939 | Von Dachenhausen | 63/15.4 |
| 2,493,285 | A | * | 1/1950 | Granat | 63/15.2 |
| 2,522,954 | A | | 9/1950 | Manne | |
| 2,726,520 | A | | 12/1955 | Debler | |

(List continued on next page.)

FOREIGN PATENT DOCUMENTS

| | | | | |
|---|---|---|---|---|
| DE | 4302493 A1 | * | 8/1994 | A44C/13/00 |
| FR | 2581295 A1 | * | 11/1986 | A44C/9/00 |
| FR | 2701639 A1 | * | 8/1994 | A44C/13/00 |

OTHER PUBLICATIONS

"Fall Bridal 2002", Littman Jewelers/Barclay Jewelers, Dec. 24, 2002. 4pgs.

*Primary Examiner*—Robert J. Sandy
*Assistant Examiner*—Thomas Ho
(74) *Attorney, Agent, or Firm*—Buckley, Maschoff & Talwalkar LLC

(57) ABSTRACT

An engagement set includes a wedding band and an engagement ring to which the wedding band is removably coupled. The shank of the wedding band when joined together with the engagement ring may be inclined relative to the shank of the engagement ring to form an "X" configuration and thereby to symbolize a "kiss". The engagement set may be joined by a locking mechanism formed of a locking feature on the wedding band and a corresponding recess on the inner surface of the front of the engagement ring. The locking feature and the recess may have an emotionally symbolic shape such as a heart shape or an "X". There may be an inclined groove at an inner surface of the back of the engagement ring to accommodate the shank of the wedding band when the rings are coupled together.

2 Claims, 3 Drawing Sheets

U.S. PATENT DOCUMENTS 3,307,374 A * 3/1967 Kirshbaum ..... 63/1.11
4,118,948 A * 10/1978 Gralnik ..... 63/15
4,307,502 A * 12/1981 Scola ..... 29/896.412
5,076,073 A * 12/1991 Boucheron ..... 63/29.1
5,253,490 A 10/1993 Doganay
D343,590 S * 1/1994 Dubs ..... D11/20
D348,022 S 6/1994 Sandberg
5,417,085 A * 5/1995 Regev ..... 63/15.2
5,419,158 A * 5/1995 Sandberg et al. ..... 63/15.4
5,483,808 A 1/1996 Barbazza
5,566,557 A 10/1996 Pasquetti
D376,556 S * 12/1996 Indorf ..... D11/29
5,596,887 A * 1/1997 Bergagnini ..... 63/15.1
5,600,972 A * 2/1997 Magi et al. ..... 63/15.1
5,669,241 A * 9/1997 Kohl ..... 63/15.2
5,682,768 A * 11/1997 Nissenbaum ..... 63/15.1
D392,585 S 3/1998 Kohl
5,727,399 A * 3/1998 Bergagnini ..... 63/15.4
5,735,144 A * 4/1998 Gabel ..... 63/15.1
5,806,344 A * 9/1998 Bonchek ..... 63/15.1
6,101,843 A * 8/2000 Nagano ..... 63/15.4
6,484,536 B1 * 11/2002 Gould ..... 63/15.1
2002/0069671 A1 * 6/2002 Richardson ..... 63/15.9

* cited by examiner

ENGAGEMENT SET WITH LOCKING ARRANGEMENT AND REAR CROSSOVER CONFIGURATION

CROSS-REFERENCE TO RELATED APPLICATION

This application claims priority from provisional U.S. application Ser. No. 60/427,659, filed Nov. 19, 2002, which is incorporated herein by reference in its entirety.

FIELD OF THE INVENTION

This invention relates to jewelry and more particularly to wedding band-engagement ring sets (also known as "engagement ring sets" or "engagement sets").

BACKGROUND OF THE INVENTION

Engagement sets are well known. However, the degree of balance and visual integration of the two rings of the set, when not worn together, often is not particularly appealing. Moreover, the present inventor has recognized opportunities for novel engagement set configurations that attractively symbolize and express a married couple's mutual love and affection, unity and connection to each other. These novel configurations may also promote secure and comfortable wearing of the two rings of the engagement set.

SUMMARY OF THE INVENTION

According to a first aspect of the invention a ring set includes a first ring and a second ring. The first ring has a main body configured to encircle or substantially encircle a wearer's finger, and a feature on the main body, the feature having a profile. The second ring has a top portion and a shank. The top portion and the shank of the second ring join together in a configuration to encircle or substantially encircle the wearer's finger. The top portion of the second ring has a recess formed in an inner surface of the top portion. The recess has a profile that substantially matches the profile of the feature on the main body of the first ring.

In some embodiments, the feature on the main body of the first ring may extend axially outwardly from the main body. In some embodiments, the profile of the feature on the main body of the first ring may be substantially X-shaped or substantially heart-shaped. The main body of the first ring may be substantially annular. The shank of the second ring may be substantially helical.

The shank of the second ring may have a groove at an inside surface of the shank, with the groove being positioned at a location opposite from the top portion of the second ring. The groove may define a plane that is inclined from a course defined by the shank.

According to a further aspect of the invention, an engagement ring has a locking recess at an inner surface of a front portion of the ring. The engagement ring also has a groove at an inner surface of a rear portion of the engagement ring. The locking recess is configured to receive a locking feature of a wedding band. The groove entirely crosses a vertical extent of the rear portion of the engagement ring in an inclined fashion.

The locking recess may have a profile that is substantially X-shaped or substantially heart-shaped.

According to another aspect of the invention, a ring set includes a first ring and a second ring to which the first ring is removably coupled. A back portion of the first ring is inclined relative to a back portion of the second ring.

The back portion of the first ring may be received within a groove formed in an inside surface of the back portion of the second ring.

The first ring may be coupled to the second ring via a feature at a front portion of the first ring that is received into a recess in an inner surface of a front portion of the second ring.

Alternatively, the first ring may have an outward-facing slot at a front portion of the first ring, the second ring may have an inward-facing slot at a front portion of the second ring, and respective floor surfaces of the two slots may be in contact with each other. The first and second rings may each have respective generally helical courses.

According to still another aspect of the invention, an engagement set includes first and second rings and a coupling mechanism for removably coupling the first and second rings to each other. The coupling mechanism is formed of respective components of the rings. The rings have respective shanks that are inclined relative to each other when the rings are coupled to each other via the coupling means.

The shank of one of the rings may include a groove to receive the shank of the other one of the rings. The coupling mechanism may include a feature on one of the rings and a recess on the other one of the rings, the recess being shaped and sized to receive the feature.

Alternatively, the coupling mechanism may include respective slots on the rings, the slots being complementary to each other. The shanks of the rings may be helical.

The components of the rings which form the coupling mechanism may be positioned so as to be hidden when the rings are worn on a wearer's finger while being coupled to each other. The respective shanks of the rings may form an "X" configuration when the rings are coupled to each other via the coupling mechanism.

In an engagement set in accordance with one or more aspects of the present invention, the engagement ring and the wedding band may be securely joined together so as to promote comfort fit in wearing the two rings. The two rings may cross at the backs of the rings to form an "X" configuration. Since an "X" is a traditional symbol of a "kiss", the cross configuration of the ring backs may convey a positive emotional experience to the wearer.

Furthermore, the locking mechanism between the two rings may include a feature and a recess having a heart-shaped or "x" shaped profile, which also may symbolize affection and love, and may also convey a positive emotional experience to the wearer. Also, since the locking mechanism features may be hidden while the rings are worn, the love and affection symbolized by the locking mechanism may be represented as "secret" or private, which may further enhance the positive emotional experience conveyed to the wearer. Even regardless of the specific profile of the locking mechanism components, the locking mechanism itself may symbolize the union between the wearer and her spouse, thereby again conveying a positive emotional experience to the wearer.

The foregoing and other objects, features and advantages of the invention will be further understood from the following detailed description of the preferred embodiments thereof and from the drawings, wherein like reference numerals identify like components and parts throughout.

DESCRIPTION OF PREFERRED EMBODIMENTS

This invention is concerned with various embodiments of an engagement set made up of an engagement ring and a wedding band both having novel configurations so that the two rings can be joined together and worn in a novel manner. In the following description of the two rings, the rings will generally be described as if resting on a horizontal surface; what is sometimes in the industry referred to as the "top" of a ring (i.e., the part having the ornamentation and/or stone setting) will in some cases be referred to in this document as the "front" or "front portion" (or "top portion") of the ring; the part of the ring sometimes referred to in the industry as the "shank" of the ring will in some cases be referred to herein as the "back" or "rear" (or "back portion" or "rear portion") of the ring.

A first embodiment of the invention will now be described with reference to FIGS. 1–5 and 7–9.

Figure 1:
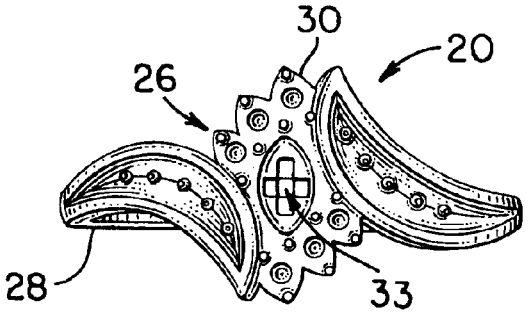
FIG. 1 is a front view of an engagement ring that is a part of an engagement set in accordance with a first embodiment of the invention.
Figure 2:
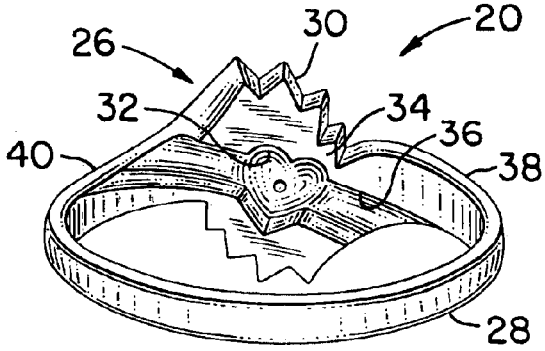
FIG. 2 is a perspective view of the engagement ring of FIG. 1, showing an inner surface of the front portion of the engagement ring.
Figure 3:
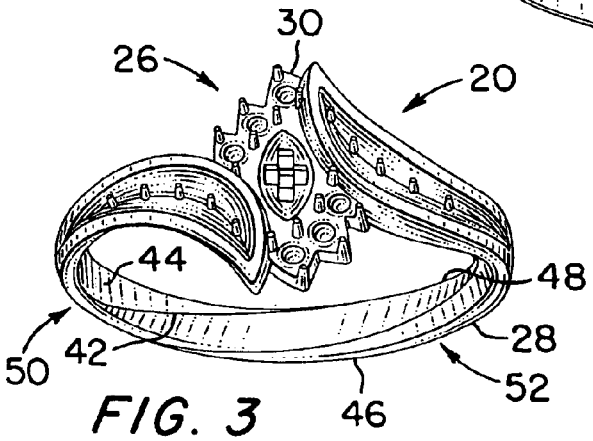
FIG. 3 is a perspective view of the engagement ring of FIGS. 1 and 2, showing an inner surface of the shank of the engagement ring.
Figure 7:
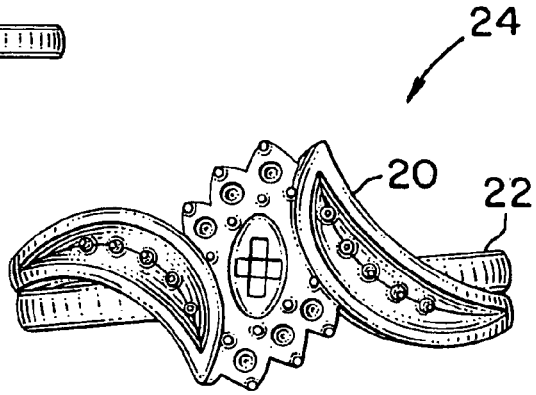
FIG. 7 is a front view of the engagement set according to the first embodiment, with the engagement ring and wedding band thereof coupled together.
Figure 8:
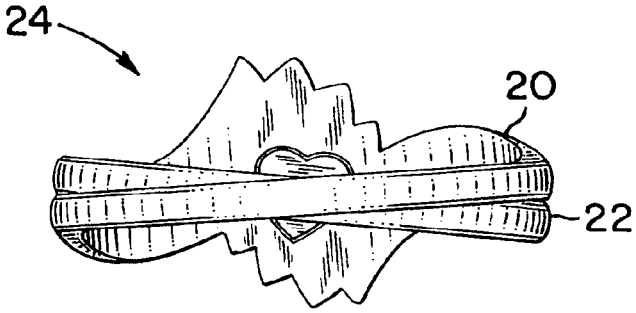
FIG. 8 is a rear view of the engagement set according to the first embodiment, with the engagement ring and wedding band thereof coupled together.
Figure 9:
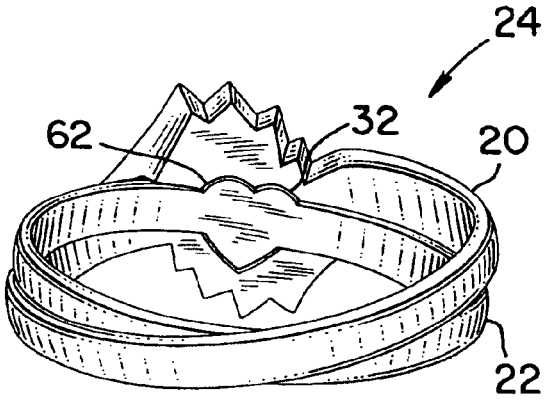
FIG. 9 is a perspective view of the engagement set according to the first embodiment, showing the inner surfaces of the fronts of the engagement ring and wedding band to illustrate a locking mechanism of the engagement set with the rings coupled together.

An engagement ring 20 of the engagement set according to the first embodiment is shown by itself in FIGS. 1–3. A wedding band 22 of the engagement set according to the first embodiment is shown by itself in FIGS. 4 and 5. The engagement set 24 of the first embodiment, consisting of the engagement ring 20 and the wedding band 22, is shown in FIGS. 7–9 with the rings 20 and 22 coupled together.

FIG. 1 is a front view of the engagement ring 20; FIG. 2 is a perspective view of the engagement ring 20 taken from behind the engagement ring; and FIG. 3 is a perspective view of the engagement ring 20 taken from in front of the engagement ring.

The engagement ring 20 includes a top portion 26 and a shank 28. The top portion 26 of the ring 20 includes an ornamental setting 30. Although the ornamental setting 30 is depicted in the drawings without stones set therein, it will be appreciated that in practice the ring 20 may be sold to the ultimate consumer with stones (e.g., diamonds) present in the setting 30.

As is conventional, the top portion 26 and the shank 28 together join in a configuration to encircle the wearer's finger.

Referring to FIG. 2, a recess 32 is formed in an inner surface 34 of the top portion 26 of the ring 20. In the particular embodiment illustrated in FIGS. 2 and 9, the recess 32 is substantially heart-shaped. The recess 32 is shaped and sized to receive a feature (to be described below) of the wedding band 22 and has a profile that matches the profile of the feature of the wedding band 22. The recess 32 may be located directly behind a center (indicated at 33 in FIG. 1) of the ornamental setting 30.

A groove 36 is also formed in the inner surface 34 of the top portion 26 of the ring 20. The groove 36 is inclined relative to the sides 38, 40 of the shank 28 of the ring 20, and is interrupted at a central portion of the groove 36 by the recess 32. The groove 36 is provided to accommodate a forward portion of the shank of the wedding band 22 when the wedding band 22 is coupled to the engagement ring 20.

Referring to FIG. 3, a second groove 42 is formed in an inner surface 44 of the shank 28 at a location opposite from the top portion 26 of the ring 20. The groove 42 is inclined relative to the shank 28 of the ring 20. In other words, the groove 42 defines a plane that is inclined from a course defined by the shank. It will be observed that the groove 42 traverses the shank 28 in an inclined fashion from a lower edge 46 of the shank 28 to an upper edge 48 of the shank, thereby crossing the complete vertical extent of the rear portion of the shank 28 of the ring 20. The groove 42 is provided to accommodate a rearward portion of the shank of the wedding band 22 when the wedding band 22 is coupled to the engagement ring.

The shank 28 of the engagement ring 20 may be substantially helical (with a small vertical displacement between the ends of the shank 28), as best seen in FIG. 8. Moreover, the shank may be shaped at its sides (indicated at 50 and 52 in FIG. 3) to accommodate movement of the wedding band 22 into the groove 42.

Figure 4:
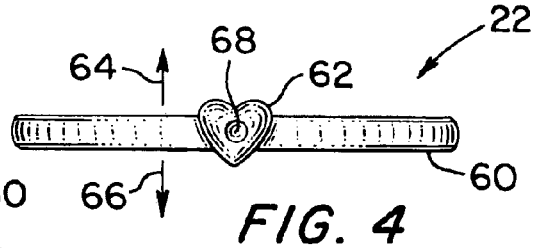
FIG. 4 is front view of a wedding band that is part of the engagement set in accordance with the first embodiment of the invention.
Figure 5:
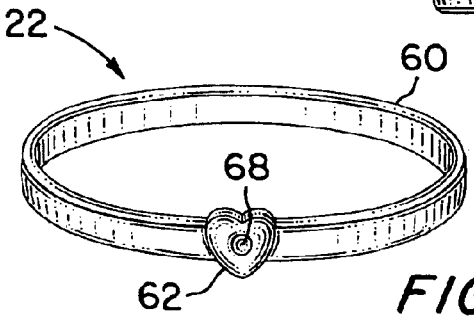
FIG. 5 is a perspective view of the wedding band of FIG. 4.

Referring to FIGS. 4 and 5, the wedding band 22 of the first embodiment will now be described.

Figure 6:
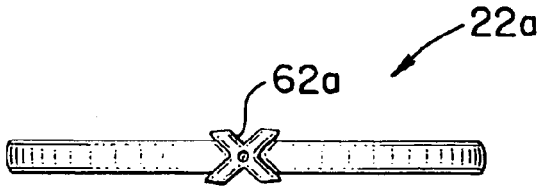
FIG. 6 is a front view of a wedding band that is suitable for use as part of an engagement set according to a second embodiment of the invention.

The wedding band 22 includes a main body 60, which is configured to encircle the wearer's finger and may be substantially annular. (The main body 60 may be considered to be the shank of wedding band 22.) The wedding band 22 also includes a locking feature 62, which in this particular embodiment is substantially heart-shaped. The locking feature 62 has a profile that matches the profile of the recess 32 of the engagement ring 20, and is shaped and sized to be lockingly received within the recess 32 when the wedding band 22 is coupled to the engagement ring 20. As best seen in FIG. 4, the locking feature 62 may extend axially (i.e., in one or both of the directions indicated by arrows 64, 66) relative to the main body 60 of the wedding band 22. (In a second embodiment illustrated in FIG. 6, the locking feature 62*a* is substantially "X"-shaped. The locking feature may have a wide variety of other shapes, and in each case the engagement ring may have a locking recess that has a profile that corresponds to the profile of the locking feature of the wedding band.)

In addition to functionally serving to couple the wedding band 22 to the engagement ring 20, the locking feature 62 also serves a decorative or ornamental function. Thus, the heart-shaped feature 62 shown in FIGS. 4 and 5 may symbolize love and affection between the ring's wearer and her spouse, and may include a stone setting hole 68 in which a precious stone may be set. The "X"-shaped feature 62*a* shown in FIG. 6 may be accorded the traditional meaning of representing a "kiss" and thus may also symbolize love and affection between the ring's wearer and her spouse.

FIGS. 7–9 show the engagement set 24 in an assembled condition, with the wedding band 22 removably coupled to the engagement ring 20. FIG. 7 is a front view of the assembled engagement set 24; FIG. 8 is a rear view of the assembled engagement set 24; and FIG. 9 is a perspective view taken from behind of the assembled engagement set 24.

To assemble the engagement set 24 from the engagement ring 20 and the wedding band 22, the locking feature 62 of the wedding band 22 may be inserted into the recess 32 of the engagement ring 20 and the main body 60 of the wedding band 22 may be rolled into a position such that the main body 60 is held by the grooves 36, 42 of the engagement ring 20.

As best seen in FIG. 8, in the assembled engagement set 24 the back portion of the wedding band 22 is inclined relative to the back portion of the engagement ring 20. It will be understood that the back portion of the wedding band 22 is received within the groove 42 (FIG. 3) of the engagement ring 20. As FIG. 8 shows, when the engagement set 24 is assembled, the respective back portions of the engagement ring and wedding band form an "X" configuration, and thus may symbolize a "kiss".

FIG. 9 shows the coupling of the wedding band 22 to the engagement ring 20 via the locking feature 62 which is received in the recess 32 of the engagement ring 20. Thus the feature 62 and the recess 32 together constitute at least part of a locking or coupling mechanism for the engagement set 24.

To disassemble the engagement set 24, the wedding band 22 may be "clicked" out of engagement with the grooves 36 and 42, and the feature 62 extracted from the recess 32.

Those who are skilled in the art will appreciate that the ornamental setting 30 of the engagement ring 20 is exemplary only, and that the ornamental setting 30 may be varied in many respects.

The rings 20, 22 may be subjected to size adjustment in accordance with conventional practices, although the groove 42 in the engagement ring 20 may be shortened in length if the ring 20 is reduced in size during size adjustment or may be lengthened if the engagement ring 20 is increased in size during size adjustment.

A third embodiment of the invention will now be described with reference to FIGS. 10–16.

Figure 10:
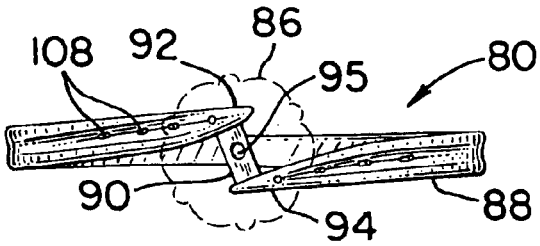
FIG. 10 is a front view of an engagement ring that is part of an engagement set according to a third embodiment of the invention.
Figure 11:
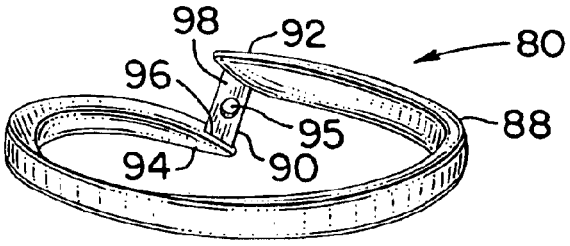
FIG. 11 is a perspective view of the engagement ring of FIG. 10, taken from behind the engagement ring.
Figure 12:
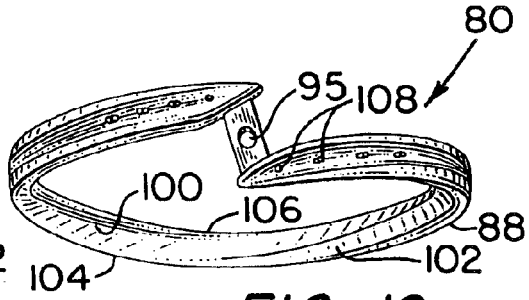
FIG. 12 is a perspective view of the engagement ring of FIGS. 10 and 11, taken from in front of the engagement ring and showing an inner surface of the shank of the engagement ring.
Figure 15:
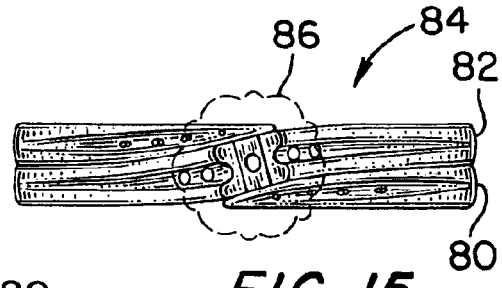
FIG. 15 is a front view of the engagement set according to the third embodiment, with the engagement ring and wedding band thereof coupled together.
Figure 16:
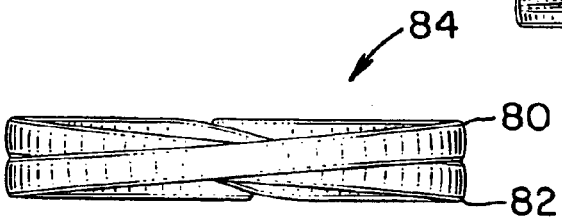
FIG. 16 is a rear view of the engagement set according to the third embodiment, with the engagement ring and wedding band thereof coupled together.

An engagement ring 80 of the engagement set according to the third embodiment is shown by itself in FIGS. 10–12. A wedding band 82 of the engagement set according to the third embodiment is shown by itself in FIGS. 13–14A. The engagement set 84 of the third embodiment, consisting of the engagement ring 80 and the wedding band 82, is shown in FIGS. 15 and 16 with the rings 80 and 82 coupled together.

FIG. 10 is a front view of the engagement ring 80; FIG. 11 is a perspective view of the engagement ring 80 taken from behind the engagement ring; and FIG. 12 is a perspective view of the engagement ring 80 taken from in front of the engagement ring. (In FIGS. 10 and 15 an ornamental setting 86 of the engagement ring 80 is shown in phantom so as to allow certain structural features of the engagement ring to be more clearly depicted; in the other drawings, the ornamental setting is omitted for the same reason.)

The engagement ring 80 includes a shank 88 which is generally helical in shape and thus defines a generally helical course. At a front portion of the ring 80 a bridge element 90 (which may be integrally formed with the shank 88) joins ends 92, 94 of the shank 88. A hole 95 is formed in the bridge element 90 to allow for soldering to the bridge element 90 a head which holds a precious stone or precious stones. The bridge element 90 may be flush with an outer side of the shank 88 and may be recessed from an inner side of the shank 88 to form an inward-facing slot 96 (FIG. 11) at the front portion of the engagement ring 80. The slot 96 has a floor surface 98 constituted by the inner side of the bridge element 90.

Referring to FIG. 12, a groove 100 is formed in an inner surface 102 of the shank 88 of the engagement ring 80 at a location opposite from the front or top portion of the ring 80. The groove 100 is inclined relative to the shank 88 of the ring 80. In other words, the groove 100 defines a plane that is inclined from a course defined by the shank. It will be observed that the groove 100 traverses the shank 88 in an inclined fashion from a lower edge 104 of the shank 88 to an upper edge 106 of the shank, thereby crossing the complete vertical extent of the rear portion of the shank 88 of the ring 80. The groove 100 is provided to accommodate a rearward portion of the shank of the wedding band 82 when the wedding band 82 is coupled to the engagement ring 80.

Also shown in FIGS. 10 and 12 are supplemental stone setting holes 108 which flank the ornamental setting 86 to allow setting of additional stones to further enhance the front of the engagement ring 80.

Figure 13:
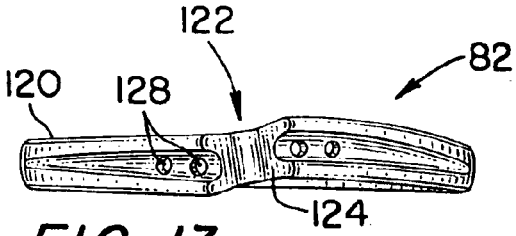
FIG. 13 is a front view of a wedding band that is part of the engagement set according to the third embodiment.
Figure 14:
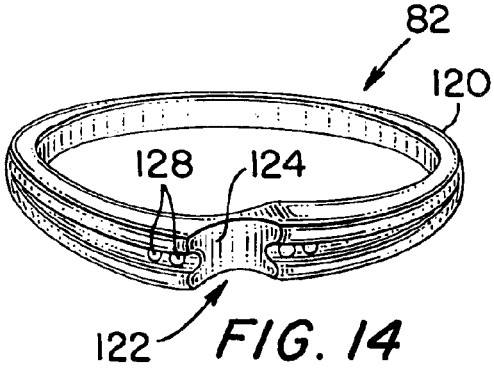
FIG. 14 is a perspective view of the wedding band of FIG. 13.
Figure 14A:
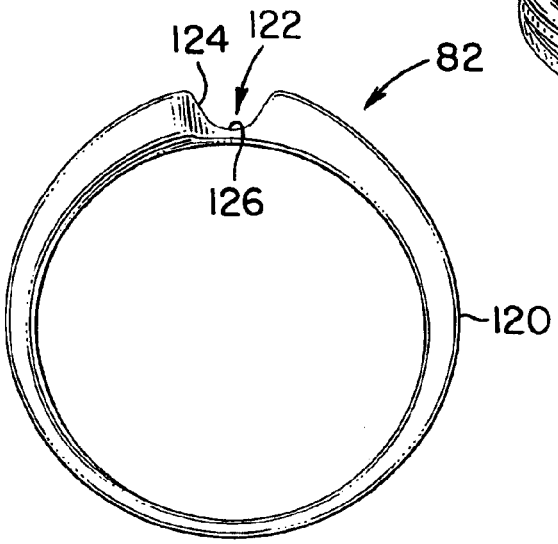
FIG. 14A is a plan view of the wedding band of FIGS. 13 and 14.

Referring to FIGS. 13–14A, the wedding band 82 of the third embodiment will now be described.

The wedding band 82 includes a generally helical shank 120 (i.e., the shank 120 defines a generally helical course) that is closed by a bridge section 122 at the front of the ring. The bridge section 122 forms an outward-facing slot 124 which has a floor surface 126 (FIG. 14A). The slots 96, 124, respectively of the rings 80, 82, may be shaped and sized so as to be complementary to each other (i.e., the slots may fit inside each other when the wedding band 82 is coupled to the engagement ring 80).

The wedding band 82 also may include stone setting holes 128 (FIGS. 13 and 14) which flank the bridge section 122 at the front of the wedding band 82 and which thus may constitute an ornamental portion of the wedding band 82.

FIGS. 15 and 16 show the engagement set 84 in an assembled condition, with the wedding band 82 removably coupled to the engagement ring 80. FIG. 15 is a front view of the assembled engagement set 84, and FIG. 16 is a rear view of the assembled engagement set 84.

To assemble the engagement set 84, the respective floor surfaces of the slots 96, 124 of the rings 80, 82 may be brought into contact with each other and the wedding band 82 may be rolled so that its shank 120 is held in the groove 100 (FIG. 12) of the engagement ring 80.

As best seen in FIG. 16, in the assembled engagement set 84, the back portion of the wedding band 82 is inclined relative to the back portion of the engagement ring 80, with the back portion of the wedding band 82 being received within the groove 100 of the engagement ring 80. As FIG. 16 shows, when the engagement set 84 is assembled, the respective back portions of the engagement ring 80 and the wedding band 82 form an "X" configuration, and thus may symbolize a "kiss".

The engagement sets disclosed herein allow for removable coupling of the wedding band to the engagement ring for convenience and comfort in wearing. The coupling of the rings to each other may also have symbolic significance by representing the joining of the wearer and her spouse. When assembled, the rear portions of the rings may form an "X" configuration, thus mirroring the traditional symbol for a "kiss" and symbolizing to the wearer the love and affection of her spouse.

Moreover, in the engagement sets according to the first two embodiments, a locking mechanism for the engagement set may be formed to symbolize affection and love, by being formed of components that have a heart-shaped or "X"-shaped profile, for example. The profile of the locking mechanism components may be hidden, to symbolize to the wearer that the emotional connection symbolized by the rings is in a sense a "secret" or private to the wearer, or not to be appreciated by others.

In short, one or more of the embodiments of the invention may have emotional appeal, as well as practical utility, which has not been evidenced by conventional engagement sets. Also, the structure of the engagement set may be conducive to an attractive and visually balanced ornamental portion of the combined rings.

As used herein and/or in the appended claims:

"substantially encircling" should be understood to include completely encircling;

a "course" refers to a path through space along which a ring shank extends; and an "ornamental setting" includes any setting in which a precious or semi-precious stone may be set.

Various changes in the above-disclosed ring sets may be introduced without departing from the invention. For example, the rings may have a cylindrical ("flat") inner profile or may have the rounded inner profile referred to in the industry as "comfort fit". The particularly preferred embodiments disclosed herein are thus intended in an illustrative and not limiting sense. The true spirit and scope of the invention are set forth in the following claims.

What is claimed is:

1. A ring set, comprising:

a first ring having:

a main body configured to encircle a wearer's finger; and a heart-shaped feature on the main body, the heart-shaped feature extending axially above and below the main body, the main body having a rear portion opposite to the heart-shaped feature, the main body being substantially annular; and a second ring including:

a top portion which includes an ornamental setting and a heart-shaped recess formed in a rear surface of the top portion, the heart-shaped feature of the first ring being received in the heart-shaped recess to removably couple the first ring to the second ring; and a shank integrally formed with the top portion to encircle the wearer's finger, the shank having a groove formed in an inner surface thereof and located opposite the top portion, the groove entirely crossing a vertical extent of a rear portion of the shank in an inclined fashion, the rear portion of the main body of the first ring being received in the groove, the rear portion of the main body of the first ring and the rear portion of the shank of the second ring crossing to form an "X" configuration.

2. A ring set, comprising:

a first ring having:

a main body configured to encircle a wearer's finger; and an X-shaped feature on the main body, the X-shaped feature extending axially above and below the main body, the main body having a rear portion opposite to the X-shaped feature, the main body being substantially annular; and a second ring including:

a top portion which includes an ornamental setting and an X-shaped recess formed in a rear surface of the top portion, the X-shaped feature of the first ring being received in the X-shaped recess to removably couple the first ring to the second ring; and a shank integrally formed with the top portion to encircle the wearer's finger, the shank having a groove formed in an inner surface thereof and located opposite the top portion, the groove entirely crossing a vertical extent of a rear portion of the shank in an inclined fashion, the rear portion of the main body of the first ring being received in the groove, the rear portion of the main body of the first ring and the rear portion of the shank of the second ring crossing to form an "X" configuration.

* * * * *